US005636802A

United States Patent [19]

Tagawa

[11] Patent Number: 5,636,802

[45] Date of Patent: Jun. 10, 1997

[54] CRUSHING APPARATUS

[75] Inventor: Itsuo Tagawa, Toyko, Japan

[73] Assignee: Sangojuuki Co., Ltd., Tokyo, Japan

[21] Appl. No.: 507,377

[22] PCT Filed: Dec. 16, 1994

[86] PCT No.: PCT/JP94/02125

§ 371 Date: Aug. 21, 1995

§ 102(e) Date: Aug. 21, 1995

[87] PCT Pub. No.: WO95/17569

PCT Pub. Date: Jun. 29, 1995

[30] Foreign Application Priority Data

Dec. 21, 1993 [JP] Japan ..... 5-344714

[51] Int. Cl.[6] ..... G02C 1/06

[52] U.S. Cl. ..... 241/266; 241/101.73; 30/134

[58] Field of Search ..... 241/266, 101.73; 30/134

[56] References Cited

FOREIGN PATENT DOCUMENTS

| | | |
|---|---|---|
| 0 453 773 | 10/1991 | European Pat. Off. . |
| 92 10 765.6 | 10/1992 | Germany . |
| 59-187976 | 10/1984 | Japan . |
| 63-40061 | 2/1988 | Japan . |
| 27504 | 6/1990 | Japan . |
| 154747 | 1/1991 | Japan . |
| 21773 | 1/1991 | Japan . |
| 110856 | 9/1992 | Japan . |
| 347270 | 12/1992 | Japan . |
| 2275628 | 9/1994 | United Kingdom ..... 241/101.73 |

*Primary Examiner*—Mark Rosenbaum

*Attorney, Agent, or Firm*—Lowe, Price, LeBlanc & Becker

[57] ABSTRACT

A pair of arms (2a, 2b) is rotatably supported on a support through pins (8) at their intermediate portions. A front portion of each arm extending from the portion supported by the pin (8) to the distal end has a distal end formed into a fork comprising a plurality of prongs. The claws (7a, 7a', 7a, 7b, 7b) are attached on respective distal ends of these plural prongs. Only a specific claw (7a') of the claws (7a, 7a', 7a) of one arm (2a), having a pointed conical distal end, is positioned to protrude inward farther than the remaining claws (7a, 7a) and serves to generate deep and shallow cracks where it is forcibly applied to material to be crushed. Shearing blades (10a, 10a) are provided on the front portions of respective arms (2a, 2b) in the vicinity of the portions rotatably supported by the pins (8). Furthermore, a plurality of through holes (12) are formed in the intermediate portions of the front portions of respective arms except for the portion where the shearing blades are provided and the portion where the distal-end prongs are formed.

5 Claims, 4 Drawing Sheets

CRUSHING APPARATUS

TECHNICAL FIELD OF THE INVENTION

The present invention relates to an improvement of a crushing apparatus to be attached to a working machine such as a power shovel used for collapsing wooden houses, concrete constructions, or the like.

BACKGROUND OF THE RELATED ART

A crushing apparatus designed to crush a structures by opening and closing actions of arms operated by a hydraulic cylinder is already known publicly. This kind of crushing apparatus, for example, as disclosed in the unexamined Japanese patent application JP-A-63-40061, is generally equipped with crushing blades, which is provided on the respective front ends of the arms to press and crush the concrete structure by opening and closing the arms, together with shearing blades, which are respectively provided closely to a pivot point of the intermediate portions of the arms, to shear reinforced steels, frame steels and the like exposed from the steel-reinforced concrete structure when they are crushed by the crushing blades.

However, broken pieces produced by crushing a structure are too large in size to be carried out of the site easily and to be subjected to recycling. Thus, the structure once crushed must be crushed again into smaller fragments. In order to re-crush such broken pieces of once crushed structure, the crushing apparatus such as one described in the unexamined Japanese patent application JP-A-63-40061 is not suited, because such an apparatus is extremely inefficient for this purpose.

On the other hand, there are several known crushing apparatuses capable of crushing large size broken pieces into smaller pieces as disclosed in the unexamined Japanese patent application JP-A-59-187976 and JP-A-4-347270. According to these prior art apparatuses, in each of the paired arms, there are provided through holes at an intermediate portion of a front portion of the arm (i.e. a region extending from the pivot point of arms to the distal end thereof). Furthermore, one of these paired arms is provided with protrusions or rollers at its intermediate portion. Thus, the broken pieces, produced when the structure is demolished, are scooped with these paired arms. Then, these broken pieces are crushed further into smaller pieces with these paired arms closing, while allowing the smaller broken pieces to pass through the above-described through holes.

Demolition work of wooden houses or concrete structures is generally classified into the following categories:

(1) demolition of wooden or concrete columns, beams, and walls;

(2) crushing of concrete blocks produced by demolition of buildings into smaller pieces;

(3) shearing of wooden beams and columns, or reinforced steels, or frame steels;

(4) collection of broken wooden pieces of beams and columns and shared reinforced steels and frame steels produced by demolition of structure; and (5) transportation of wooden fragments, reinforced steels, frame steels, concrete pieces and the like produced by demolition of structure onto a load-carrying platform of a truck or like vehicle.

When performing these works with various attachments selectively attached to a working machine such as a power shovel, a lot of time is required for replacing an attachment with another suitable for the next work and then a number of attachments are used, with the result that it is inefficient and uneconomical to perform such works. Meanwhile, in the case where the crushing apparatus such as the one disclosed in the previously-described unexamined Japanese patent application JP-A-63-40061 suited for the demolition of structures is used, the above described work (1) can be performed efficiently, but other works (2), (4) and (5) cannot be carried out or can be carried out with extremely poor efficiency. On the other hand, if the crushing apparatus such as the one disclosed in the previously-described unexamined Japanese patent application JP-A-59-187976 or the unexamined Japanese patent application JP-A-4-347270 which is suited for the work for crushing broken pieces into smaller pieces is used, the above classified works (2) through (5) can be performed effectively, but the most fundamental work (1) cannot be carried out effectively due to lack of adequate power.

Although there are known attachments suited for the above-describe works (3) through (5), those are not suited for the above-described works (1) and (2).

DISCLOSURE OF INVENTION

An object of the present invention is to provide a crushing apparatus capable of efficiently performing all of the above-described works (1) through (5) with a single crushing apparatus.

In order to accomplish the above and other related objects, one aspect of the present invention provides a crushing apparatus comprising: a pair of arms, substantially identical in configuration and rotatably supported by arm supports at their longitudinally intermediate portions, and an arm drive mechanism for simultaneously actuating rear ends of the paired arms, to cause front portions of arms respectively extending from the portion supported by the arm support, to the distal end of the arm to open and close, wherein the front portion of each arm has a shearing blade provided adjacent to the portion supported by the arm support to shear an object to be cut; a front edge divided into a fork having a plurality of prongs; a claw attached to each of the plural prongs; and a plurality of through holes opening in an intermediate region except for the portion where the shearing blade is provided and the portion where the prongs are formed, and one of the paired arms has at least one claw protruding inward farther than the remaining claws so that a front edge of the farthest claw is positioned closer to the other arm than the remaining claws.

With the above arrangement, the present invention is capable of performing its functions in the following manner.

Of plural claws attached to respective prongs of one arm, a claw whose distal end is positioned closest to the other arm is first brought into contact with the structure. A pressing force is applied to the structure through this most protruding claw; therefore, the structure is subjected to a concentrated force in the vicinity of that claw. This concentrated stress can easily cause deep and shallow cracks in the concrete structure. Subsequently, by closing the arms further in this condition, thereby causing other claws to bite into the structure for demolition of a wider area.

The broken concrete pieces produced by the demolition of concrete structure are then pressed between intermediate portions of front portions of the arms to be crushed into smaller pieces. The broken pieces, crushed into smaller pieces, fall outside passing the through holes opening in the intermediate portion of the front portion of each arm.

The broken concrete pieces broken further into smaller pieces can be scooped by the distal end portion of the arm divided into a fork. Furthermore, longer size broken materials of columns, beams, reinforced steels, frame steels and the like, can also be collected by this fork-shaped distal end of the arm.

BEST MODE FOR CARRYING OUT THE INVENTION

Figure 1:
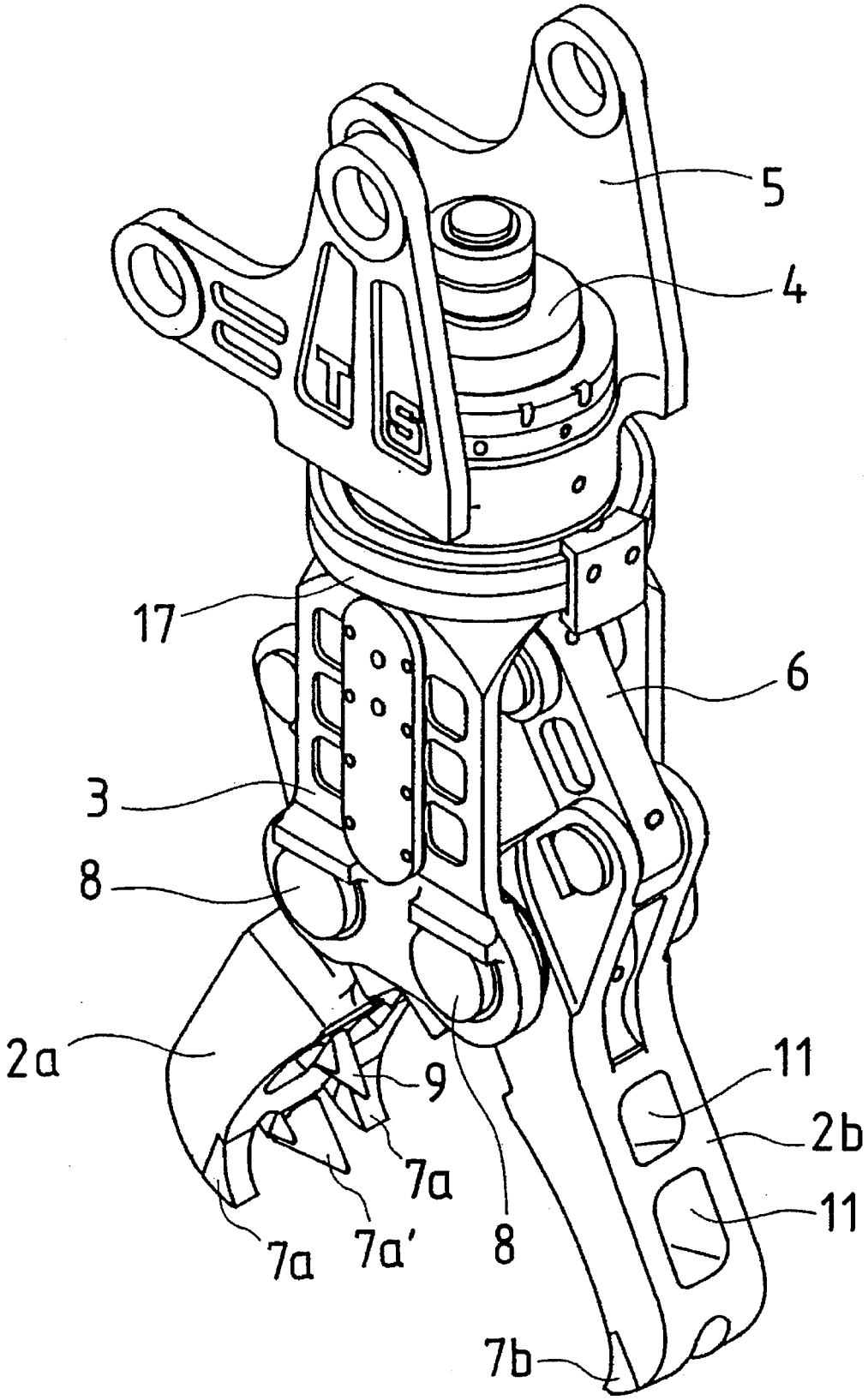
FIG. 1 is a perspective view showing a crushing apparatus in accordance with one embodiment of the present invention, wherein the front portions of arms are opened.
Figure 2:
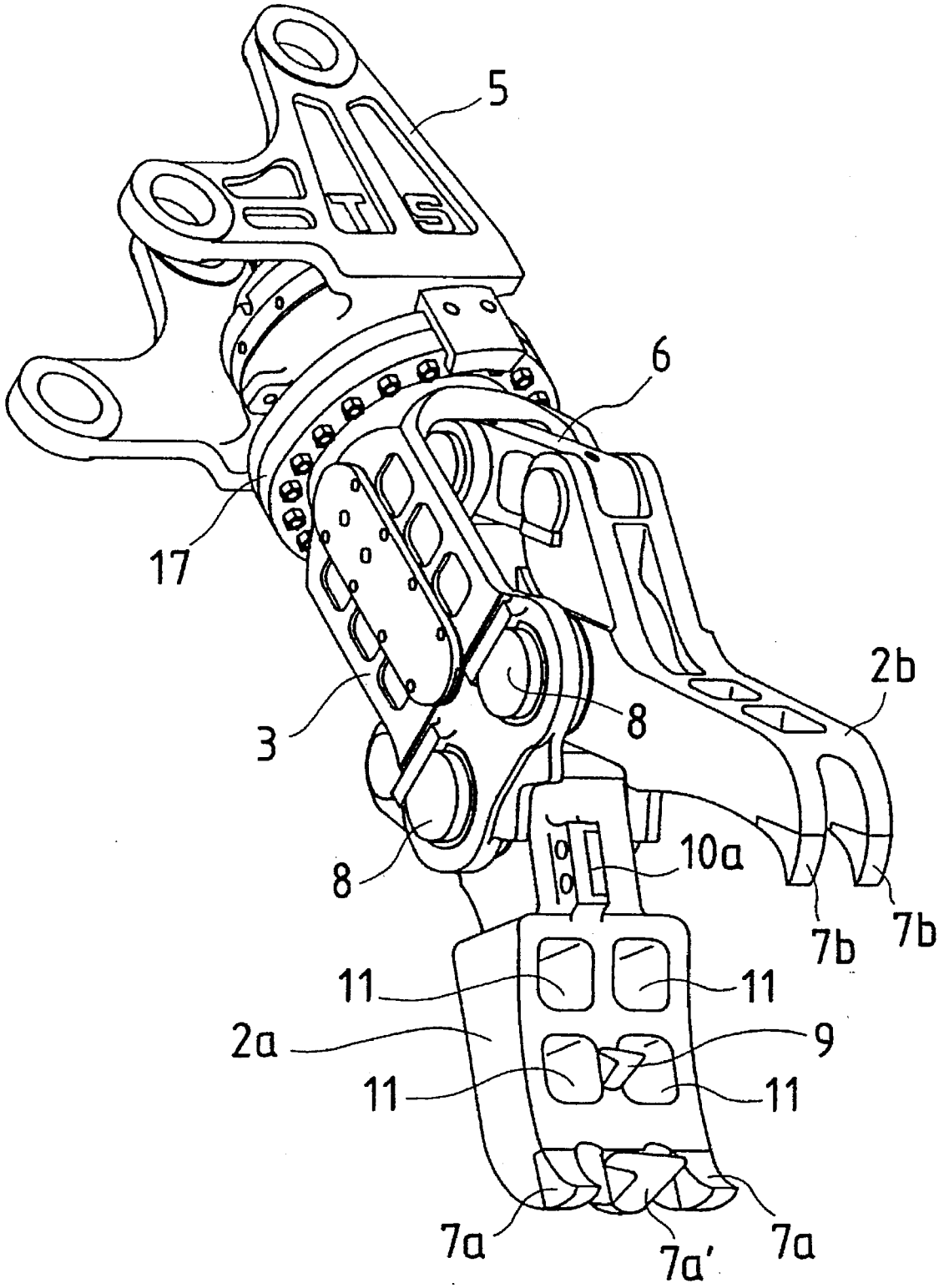
FIG. 2 is a perspective view showing the same crushing apparatus as that shown in FIG. 1 but viewed from a different direction.

A crushing apparatus 1, in accordance with one embodiment of the present invention, as shown in FIGS. 1 and 2, comprises a pair of arms 2*a* and 2*b* cooperatively pressing an object between front ends thereof, an arm support 3 supporting the arms 2*a* and 2*b* so as to be freely opened or closed, a working machine bracket 5 supporting the arm support 3 rotatably, a hydraulic cylinder 4 attached to the working machine bracket 5, and a link mechanism 6 acting as an actuating force transmitting means linking a piston rod of the hydraulic cylinder with rear ends of the paired arm 2*a* and 2*b*.

Each of the paired arms 2*a* and 2*b* has an intermediate portion rotatably supported about a pin 8 fixed on the arm support 3. A front portion of each arm, that is, a portion ranging from its intermediate part to its distal end, is bent inward, and its distal end is divided to form a fork-like shape to provide a construction comprising a plurality of prongs arranged along an axial direction of the pin 8. On the other hand, a rear portion of each of the arm 2*a* and 2*b*, that is, a portion ranging from its intermediate part to its rear end, is curved outward at a dull angle against the front portion.

Figure 5:
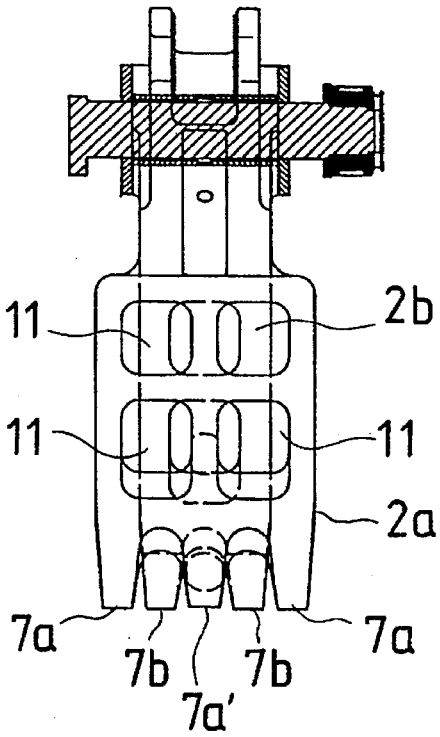
FIG. 5 is a side view (i.e. a partly cross-sectional view) showing the crushing apparatus of FIG. 4, seen from the left of FIG. 4.

The front portion of one arm 2*a* and the front portion of the other arm 2*b* have the same lateral width (i.e. a length along the axial direction of the pin 8) in the vicinity of the pin 8 as shown in FIG. 5. However, the front portion of one arm 2*a*, except for the region around the pin 8, is formed to be wider than that of the other arm 2*b*.

A claw is attached to each tip of the prongs provided on the front end of the arms 2*a* and 2*b*. More specifically, as shown in FIGS. 1 and 2, one arm 2*a* has three prongs at the front end thereof. Claws 7*a*, 7*a*' and 7*a* are attached to these prongs, respectively, by welding or the like. The other arm 2*b* has two prongs formed at its front end. Claws 7*b* and 7*b* are attached to these prongs by welding or the like.

Figure 3:
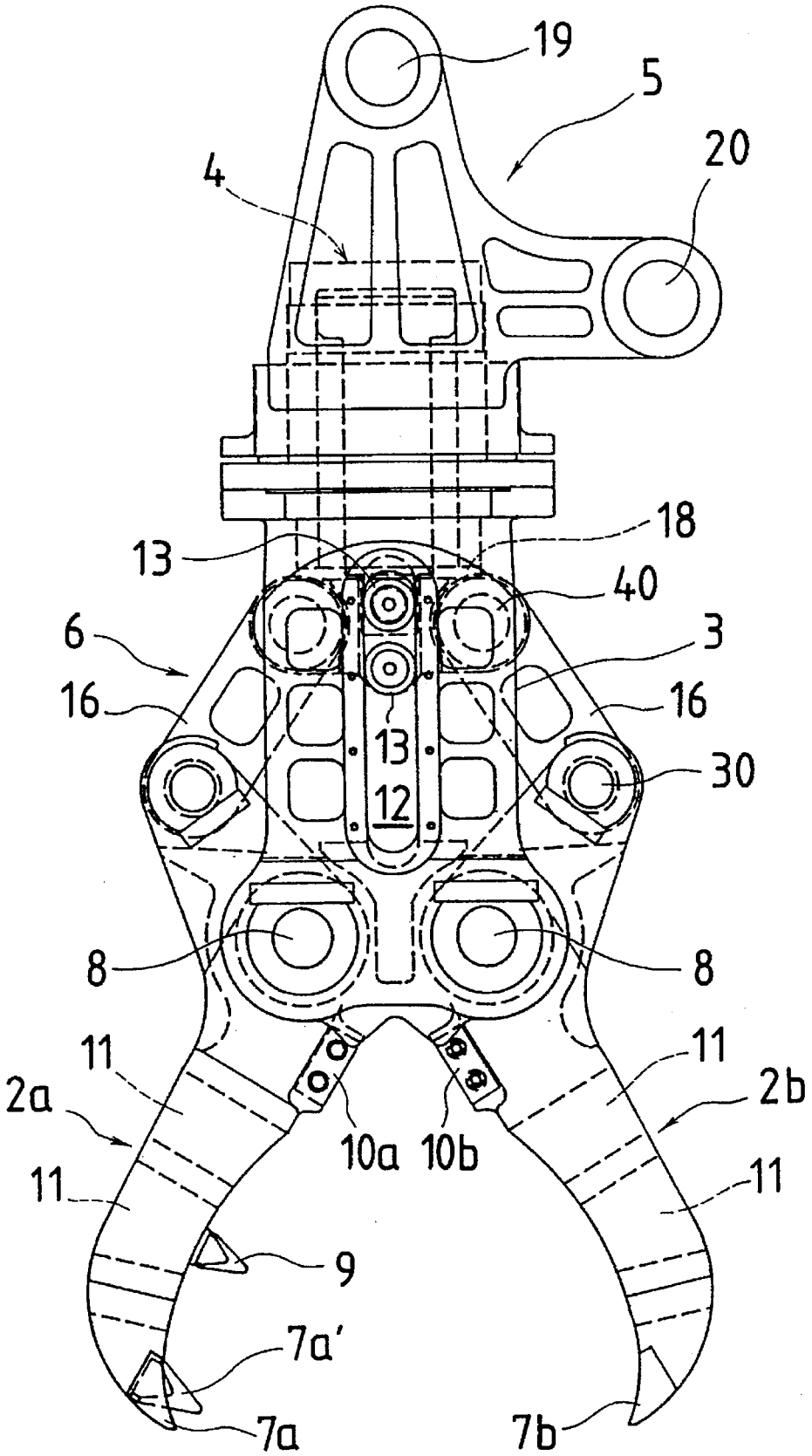
FIG. 3 is a front view showing the crushing apparatus shown in FIG. 1 wherein the front portions of a pair of arms are opened.

Of three claws 7*a*, 7*a*' and 7*a* attached to the front end of the one arm 2*a*, the centrally positioned claw 7*a*' protrudes more inward than the other two claws 7*a* and 7*a* do (that is, a protruding inclination of the claw 7*a*' is closer to the normal line of the inside surface of the front portion of the other arm 2*b* than that of the claw 7*a*). As a result, the central claw 7*a*' attached to the front end of the arm 2*a* come to be positioned closer to the front portion of the other arm 2*b* than the other two claws 7*a* and 7*a* attached to laterally opposite front ends of the arm 2*a*. Note, as best seen in FIGS. 1, 2 and 3, that claw 7*a*' has a pointed conical distal end.

Figure 4:
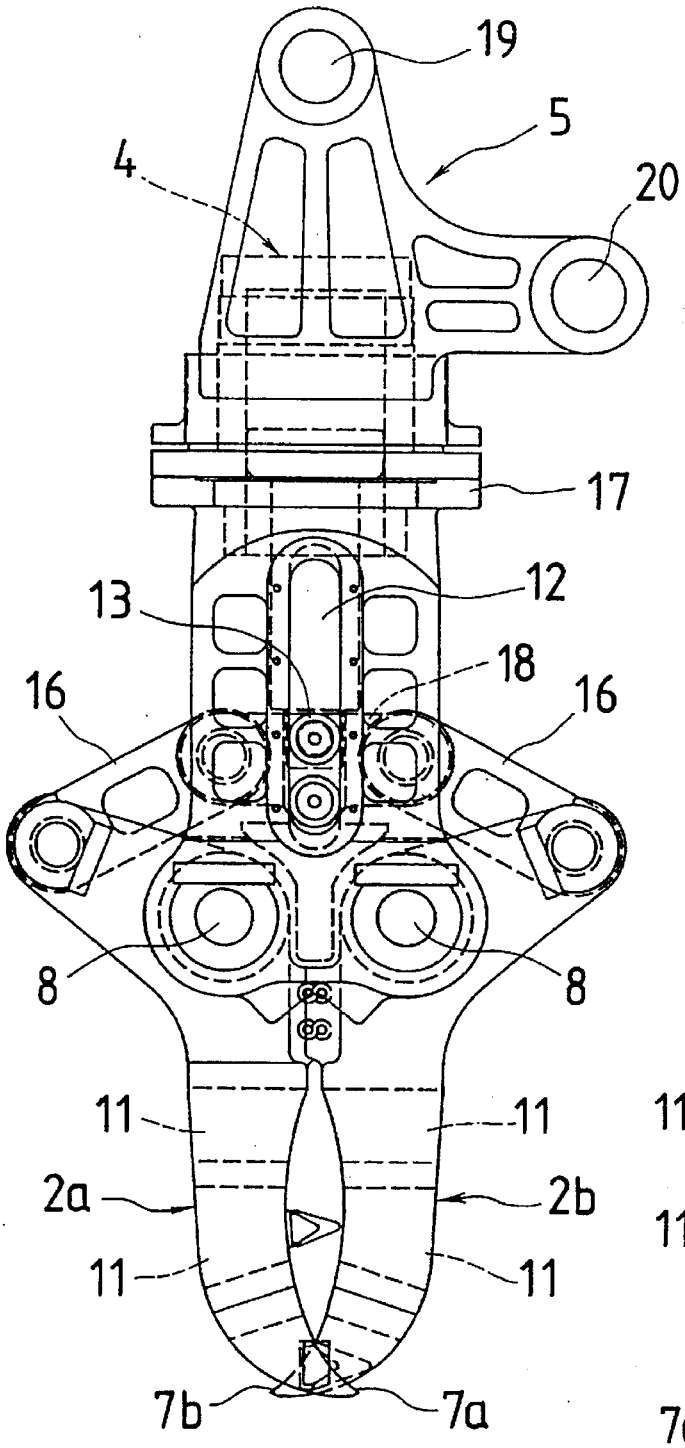
FIG. 4 is a front view showing the crushing apparatus shown in FIG. 1 wherein the front portions of a pair of arms are closed.

Furthermore, there are provided a plurality of through holes on the respective front portions of the arms 2*a* and 2*b* at their intermediate region excluding a region around the pin 8 supporting each arm and a region around the prong tip attached with the claw. One arm 2*a* is provided with a total of four through holes 11, by an arrangement of two in a lateral direction and two in a longitudinal direction. More specifically, the portion having these four through holes 11 is the laterally enlarged portion of the front portion of the one arm 2*a*. The other arm 2*b* is provided with two through holes 11 along the longitudinal direction thereof. As shown in FIG. 3, the through holes 11 of one arm 2*a* and through holes 11 of the other arm 2*b* are located to correspond with each other in longitudinal direction but not laterally, since they are deviated from each other in lateral direction. Furthermore, as shown in FIG. 3 or 4, the through holes 11 positioned near the front ends of the arms 2*a* and 2*b* have a cross section which is gradually widened from the inside surface (pressing face) to the outside surface.

Furthermore, a cracking claw 9 is attached to the solid portion between two laterally arranged through holes 11 and 11 in the one arm 2*a* by welding or the like.

Moreover, a pair of shearing blades 10*a* and 10*b* is mounted on the front portions of the respective arms 2*a* and 2*b* in the vicinity of the portion supported by the pivot axis of the pin 8, to cut off reinforcing steels, frame steels or the like.

The arm support 3, as shown in FIGS. 1 and 2, has an upper end formed into a ring flange 17. The arm support 3 is rotatably connected to the working machine bracket 5 through the ring flange 17.

Each rear end of the arms 2*a* and 2*b*, rotatably supported on the arm support 3 through the pin 8, is connected to one end of a connecting rod 16 via a pin 30. The other end of the connecting rod 16 is connected to one end of a link piece 18 via a pin 40. The other end of the link piece 18 is connected to the other connecting rod 18 via the pin 40. The link piece 18 has a central portion connected to the piston rod of the hydraulic cylinder 4. A pair of rollers 13 and 13 is provided on this link piece 18, so that these rollers 13 and 13 can move in an up-and-down direction being guided by a guide hole 12 provided in the support 3. As a result, the movement of the piston rod connected with the link piece 18 is restricted to that in the direction of the guide hole 12. With the above arrangement, the expanding or contracting motion of the piston rod of the hydraulic cylinder is converted, through the link piece 18 and connecting rod 16, into the action where the rear portions of the arms 2*a* and 2*b* swing around the pins 8 respectively, eventually causing the front portions of the arms 2*a* and 2*b* to come close to or separate from each other.

The working machine bracket 5 supports the hydraulic cylinder 4. Mounting holes 19 and 20 provided in the working machine bracket 5 are used to attach the crushing apparatus 1 to a boom tip of a working machine. The crushing apparatus 1 is swingably supported around the boom tip of the working machine through one mounting hole 19. An actuator of the working machine, pivotally supported through the other mounting hole 20, is expanded or contracted in order to enable the crushing apparatus 1 to shift its portion around the mounting hole 19.

Now, a demolition work of concrete structure using the crushing apparatus 1 of the present invention will be explained.

The rotational angle of the arm support 3 with respect to the working machine bracket 5 is determined so that the paired arms 2*a* and 2*b* are set ready for holding fast the structure, such as concrete walls, columns or the like, from the direction normal to the longitudinal direction of these structures. Thereafter, the structures are pressed between the claws 7*a*, 7*a*' and 7*a* provided on the front edge of the one arm 2*a* and the claws 7*b* and 7*b* provided on the front edge of the other arm 2*b*, thereby crushing the structures. Since distal ends of a pair of arms 2*a* and 2*b* are curved inward respectively, even when the structure comes between the claws 7*a*, 7*a*' and 7*a* of arm 2*a* and claws 7*b* and 7*b* of arm 2, the structure is still not caught fast between the arms 2*a* and 2*b*, because the longitudinal intermediate portions of these arms are still left open wide.

Of the three claws 7*a*, 7*a*' and 7*a* formed on the front portion of arm 2*a*, the centrally located claw 7*a*' has its pointed conical tip situated closer to the front portion of the other arm 2*b* than other two claws 7*a* and 7*a* do. Therefore, when the paired arm 2*a* and 2*b* are closed, the central claw 7*a*' of arm 2*a* first comes into contact with the structure prior to the claws 7*a* and 7*a* at a point between claws 7*a* and 7*a*. On the other hand, two claws 7*b* and 7*b* on the other arm 2*b* are simultaneously brought into contact with the construction. (Otherwise, the portions near the claws 7*b* and 7*b* is first brought into contact with the construction.)

If the arms 2*a* and 2*b* are further closed from this condition, the pointed conical tip of longer central claw 7*a*' of the one arm 2*a* bites into the structure, with a concentrated stress acting at this point. As a result, the concrete structure will be cracked deep or shallow in the area subjected to biting force of the claw 7*a*'. If the arms 2*a* and 2*b* are further closed from this condition, all of three claws 7*a*, 7*a*' and 7*a* of the one arm 2*a* come into contact with the structures. Thus, the area compressed by these claws is surely increased. As this stage, the concrete structure has already become brittle due to the shallow and deep cracks occurred therein, so that the actions of all the claws 7*a*, 7*a*', 7*a*, 7*b* and 7*b* collaborate to facilitate crushing work.

As described above, one claw 7*a*' among a plurality of claws formed on one arm 2*a* is used to exert a concentrative force on a particular point of concrete structure, causing the shallow and deep cracks to occur to weaken the structure at its point of contact, and then all the claws are collaboratively used to compress the wider area of the weakened structure to be crushed.

After the concrete structure is crushed, many of reinforced steels, frame steels or the like are bared, which are then cut off by the shearing blades 10*a* and 10*b* provided on the front portions of the arms 2*a* and 2*b* in the vicinity of the portion supported by the pin 8.

The broken pieces of the concrete produced by crushing the concrete structure is scooped with the arm 2 while the arms 2*a* and 2*b* are kept open. Thereafter, the scooped broken pieces of structure is held within the curved surface of the one arm 2*a*, and the arms 2*a* and 2*b* are closed to compress the broken concrete pieces between the front portions of respective arms to break them further into smaller pieces. The front portion of the one arm 2*a*, as shown in FIG. 5, is formed to have a laterally enlarged portion except for a part of the portion supported by the pin 8. Therefore, broken pieces of concrete or the like can be smoothly scooped up by this laterally enlarged portion.

The broken concrete pieces pressed and crushed into smaller pieces by the arms 2*a* and 2*b* pass the through holes 11 formed on the front portions of the arms to fall outside of the clearance between arms 2*a* and 2*b*.

Especially, in the event that the demolition of concrete structure produces relatively large concrete blocks, such large blocks can be further broken by compressing them between confronting claws 7*a*, 7*a*', 7*a* and 7*b*, 7*b* as described previously.

On the other hand, when the broken concrete pieces are relatively small, they are held by the intermediate parts of the front portions of the arms 2*a* and 2*b*. Since the claw 9 is formed on the intermediate part of front portion of the one arm 2*a*, protruding toward the other arm 2*b*, this claw 9 first bites into the broken concrete pieces held between the curved portions of the arms 2*a* and 2*b* in the process of closing the arms 2*a* and 2*b*. Thus, the claw 9 exerts a concentrated force on a particular point on each of broken concrete pieces, thereby causing each concrete block to be crushed easily into smaller pieces. In this manner, concrete blocks are further crushed into smaller pieces of predetermined size or less for recycling.

If the columns, walls, beams or the like of the concrete structures are not so large, it will be sufficient to weaken and demolish the structures by compressing them between the claws 7*a*' and 9 and the other arm.

Furthermore, since not so large a force is required to demolish wooden houses, it may be possible to crush their columns, beams and walls by clutching and compressing them between the intermediate portions of two arms 2*a* and 2*b*.

Long size broken columns, beams, reinforced steels, frame steels and the like, which are produced by demolishing and collapsing the structure to the ground, can be scooped up with the arm 2*a* by opening the arms 2*a* and 2*b* and moving the distal-end claws 7*a* and 7*a* of the arm 2*a* along the surface of the ground. The distal end of the arm 2*a* is divided into a fork and formed laterally wider than the distal end of the other arm 2*b*, and so these long size broken materials can be collected efficiently.

When moving long size materials such as columns, beams, reinforcing steels and steel frame, collected and accumulated in the heap, to another location, or when loading such materials on the bed of a truck, the intermediate parts of the front portions of arms 2*a* and 2*b* hold and carry these long size broken materials. When releasing these long size broken materials, the other arm 2*b* is positioned slightly lower than the arm 2*a*. The claws 7*b* and 7*b* attached to the prongs of the arm 2*b* are identical with each other in both configuration and protruding length, respectively providing a curved surface smoothly continuing from the main part of the front portion of arm 2*b*, thereby making it possible to smoothly release the long size broken materials from the front portion of arm 2*b* without hitch.

Although the above-described embodiment discloses only one claw 9 provided at the intermediate portion of the front portion of the one arm 2*a*, a plurality of claws may be provided. Alternatively, this claw 9 may be provided on the other arm 2*b*. Furthermore, as the arms 2*a* and 2*b* have their front portions curved inward as shown in FIGS. 1 and 2, the intermediate portions of the front portions of both arms 2*a* and 2*b* will not come into contact with each other even if these arms 2*a* and 2*b* are completely closed, thus leaving a gap therebetween. For this reason, the claw 9 provided at the intermediate portion of the front portion of one arm 2*a* acts so effectively that it can surely weaken the object coming between the intermediate portions of the front portions of arms 2*a* and 2*b*.

However, the claw 9 need not be provided on one arm 2*a*, if the front portions of the arms 2*a* and 2*b* are designed so that their confronting sides come into contact fully with each other leaving no gap therebetween when the arms 2*a* and 2*b* are completely closed. Even in such a case, broken concrete pieces can further be crashed into smaller pieces between the solid sections of the front portions of the two arms, each of the solid section being located between through holes 11 in each of the arms.

Still further, if the hydraulic cylinder 4 has a large output, a plurality of claws 7*a*, 7*a*' attached to one arm 2*a* can be arranged as follows. Of these plural claws 7*a*, 7*a*', two or more claws 7*a*' - - - are protruded inward farther than the remaining claws 7*a* - - - so that the distal ends of these claws 7*a*' - - - are positioned closer to the front portion of the other arm 2*b* than the distal ends of the remaining claws 7*a* - - - .

I claim:

1. A crushing apparatus, comprising:

a pair of arms, substantially identical in shape, and rotatably supported on an arm support at their respective longitudinally intermediate portions; and an arm drive mechanism for simultaneously actuating rear ends of said pair of arms to cause respective front portions of the arms, extending from the point where an arm is supported by said arm support to the distal end of the arm, to be opened and closed, wherein said front portion of each arm has a shearing blade provided adjacent to the portion supported by said arm support to cut off an object to be cut, a distal end divided into a fork having a plurality of prongs, a claw attached to each of said plural prongs, a plurality of through holes opening in an intermediate region other than the portion where said shearing blade is provided and the portion where said prongs are formed, and one of said pair of arms has at least one claw protruding inward farther than the remaining claws so that a distal pointed conical end of said at least one claw is positioned closer to the other arm than the remaining claws.

2. The crushing apparatus according to claim 1, wherein:

said front portions of said paired arms are curved inward respectively to present claw-shapes, and one or more claws are formed near the through holes in the front portion of one arm to extend toward the front portion of the other arm.

3. The crushing apparatus defined by claim 1, wherein:

said claws attached to said prongs at the distal ends of each of said arms are identical with each other in both configuration and protruding length, and an inside surface of each claw provides one of a flat or a curved surface continuing to an inside surface of the front portion of the other arm.

4. The crushing apparatus defined by claim 1, wherein:

said front portion of one of said paired arms has a laterally enlarged portion extending from the portion where said through holes are formed to the distal end thereof, which has a larger width than that of the remaining region.

5. The crushing apparatus defined by claim 4, wherein:

said front portion of the one arm having a laterally enlarged portion has three prongs formed at the distal end thereof, including a centrally formed prong which has a claw protruding inward farther than claws respectively attached to prongs located on both sides thereof so that the central prong has a distal end positioned closer to the other arm, and said front portion of the other arm has two prongs such that each of these two prongs confront respective spaces between adjacent two prongs of said three prongs formed on the front portion of said one arm.

* * * * *